United States Patent [19]

Leardi

[11] 4,296,503

[45] Oct. 27, 1981

[54] IN-TANK BATHROOM DEODORIZER/CLEANER

[75] Inventor: Anthony Leardi, Middletown, N.Y.

[73] Assignee: Hercules Incorporated, Wilmington, Del.

[21] Appl. No.: 122,970

[22] Filed: Feb. 20, 1980

[51] Int. Cl.[3] ..... E03D 9/02

[52] U.S. Cl. ..... 4/228; 4/227

[58] Field of Search ..... 4/227, 228

[56] References Cited

U.S. PATENT DOCUMENTS

| | | | |
|---|---|---|---|
| 645,206 | 3/1900 | Jones | 4/228 |
| 685,020 | 10/1901 | Venners | 4/228 |
| 830,680 | 9/1906 | Silvera | 4/227 |
| 2,658,206 | 11/1953 | Martinez | 4/228 |
| 2,736,039 | 2/1956 | Majo | 4/227 |
| 2,888,685 | 6/1959 | Giangresso et al. | 4/227 |

*Primary Examiner*—Henry K. Artis

*Attorney, Agent, or Firm*—William S. Alexander

[57] ABSTRACT

Novel apparatus is disclosed for deodorizing and cleansing a toilet bowl in which a fragranced detergent cake is floated on the surface of the water in the hold tank with a small volume of water on the detergent. The container holding the detergent is adapted to drop with the water as the water is exhausted during flushing and to spill the perfumed detergent containing water into the final increment of flush water leaving the tank. This water then remains in the toilet bowl after flushing.

1 Claim, 6 Drawing Figures

IN-TANK BATHROOM DEODORIZER/CLEANER

This invention relates to a device for cleansing a toilet bowl and imparting a pleasant fragrance to a room in which the toilet is contained by dispensing perfume and detergent on a controlled basis.

Various means and techniques have been known in the art for the general purpose of dispensing perfume within lavatories and bathrooms. Most of these have depended upon the addition of perfume directly to the water filling a toilet or to the water refilling a flush tank. The result of most of these arrangements is that the perfume dissolved in the water is extremely dilute and that the greater part of the perfume in the flush tank at the time of flushing immediately passes down the drain and is lost.

It is an object of this invention to provide an apparatus for fragrancing and cleansing a toilet bowl which is substantially more efficient and more effective than most of the prior art devices known to date. In particular it is an object of the invention to provide such a device which does not dispense its active ingredients until after a substantial portion of the flushing cycle has been completed.

Specifically, the improved device of this invention utilizes a floatable container containing a solid, fragranced detergent material having one of its surfaces exposed, said container being secured to a toilet tank so that it floats on the surface of the water in the tank with the exposed surface of the fragranced detergent out of contact with the body of the water in the tank and adapted to rotate between a substantially horizontal and a substantially vertical position as the water level in the tank drops during flushing, thereby releasing active ingredients into the water.

The improved device of this invention is illustrated in the attached drawing in which FIGS. 1, 1*a* and 1*b* show the change in position of the floatable container as the level of the water in the flush tank drops and recovers during the flush cycle.

Figure 1:
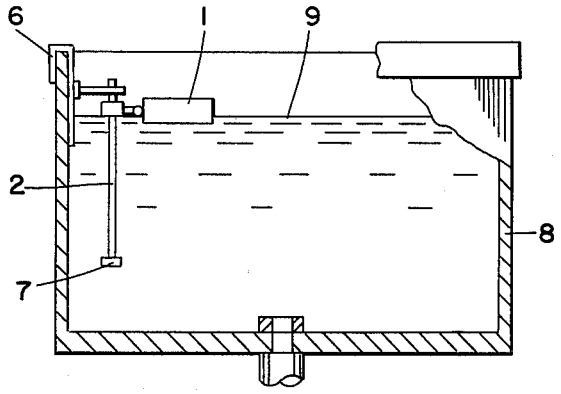
Figure 2:
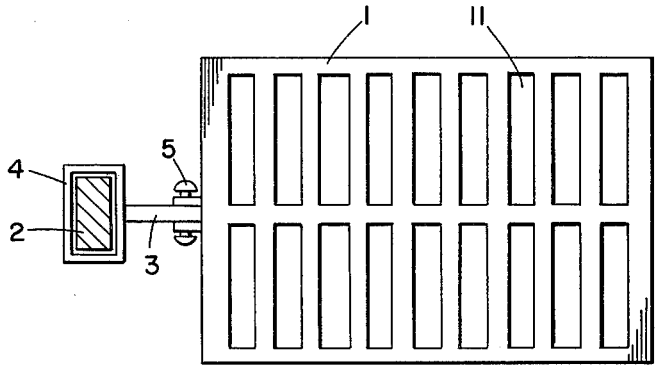
FIG. 2 is a plan view of such a container and its mounting means.
Figure 3:
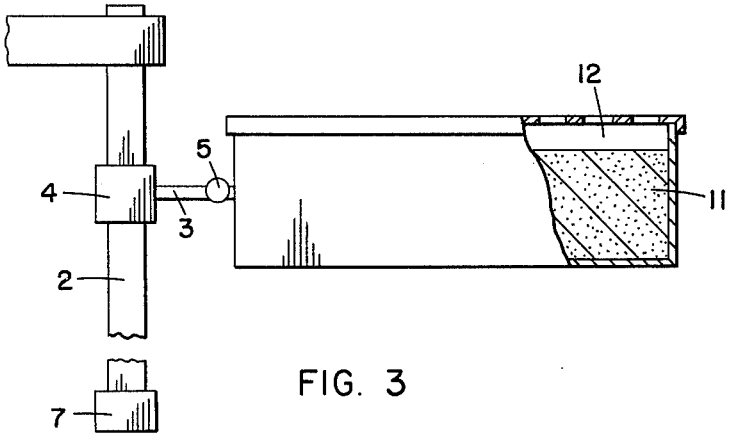
FIG. 3 is an elevation of the same embodiment of the invention.

Referring first to FIGS. 2 and 3, the fragrancing and cleansing device of the invention comprises a floatable container 1 secured in place by an adjustable length guide rod 2 by means of arm 3 and guide 4. Container 1 is secured to arm 3 through swivel 5 and adapted to pivot about swivel 5. In use, the apparatus is mounted in water tank 8 by means of mounting bracket 6 and floats on the surface of the water 10 as shown in FIG. 1.

Container 1 and its appurtenant parts are fabricated of a water floatable material, for example, a foamed plastic such as polypropylene, polystyrene or polyethylene, or of a non-floating material to which buoyant sustances have been affixed. Container 1 is charged with a solid detergent material 11, in which has been dispersed a perfume oil or a perfume composition. The perfumed detergent is charged into the container, preferably from a melt or from a congealable liquid form so that it sets up into a single block within the container. It is preferred to have the block adhering to the walls of the container. The amount of perfumed detergent charged to the container is sufficient to allow a small head space

12 between the top surface of the detergent and the top of the container so that in operation, as explained hereinafter, a pool of water can be retained upon the top surface.

The guide rod 2 and guide 4 have flat surfaces to prevent unrestrained rotation thereby ensuring no interference with the tank flushing mechanism.

To use the novel fragrancing device of this invention, the device is installed in a water closet hold tank by means of mounting bracket 6 which is sized so that it clips onto the side wall of the tank. Container 1, containing the perfumed detergent material, then floats on the surface of the water in the tank. Prior to initial operation the surface of the detergent is wetted by briefly submerging the product while the tank is full and then allowing the container to rest on the water's surface. Between flushes, this entrapped water dissolves a small amount of the detergent and leaches out a small amount of the perfume along with the dissolved detergent. Both the detergent and the perfume are retained within the container until the tank is flushed. Thus the water in the tank remains substantially free of detergent and perfume. However, the wetted block, being very efficient in diffusing fragrance odors, effectively perfumes the air space above the water surface inside the tank.

Figure 1A:
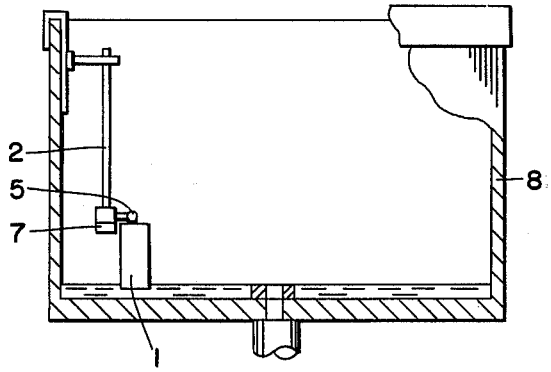

When the toilet is flushed, container 1 remains floating on the surface of the water as the water level drops, riding down on guide rod 2 until guide 4 reachs stop 7. Guide rod 2 and guide 4 preferably have flat surfaces to prevent unrestricted rotation, thereby guarding against interference with the flushing mechanism. When the container reaches stop 7 and the water level continues to drop, the container pivots about swivel 5 and discharges the water from the surface of the detergent into the tank (FIG. 1A). The flushing of the bowl being essentially complete at this point the result is that the final increment of water leaving the tank is relatively concentrated in both perfume and detergent and most of the perfume and detergent remain in the toilet bowl when the flushing is complete rather than being flushed down the drain with the bulk of the water.

Figure 4:
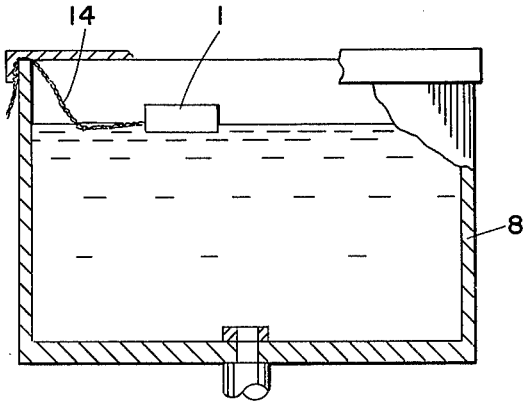
FIG. 4 illustrates an alternative installation of the container.

Alternatively, a less expensive attachment fixture can be achieved, as shown in FIG. 4, by employing a variable-length flexible cord 14 in place of guide rod 2, guide 4, stop 7, and swivel 5. The cord is held tightly by the tank cover and its length is adjusted so that container 1 remains in a horizontal floating position until just prior to the discharge of the final increment of water from the tank at which time the cord becomes taut and the container pivots to a substantially vertical position, releasing concentrated detergent and perfume into the water. Care must be taken during the placement of the device to ensure no interference with the tank flushing mechanism.

Figure 1B:
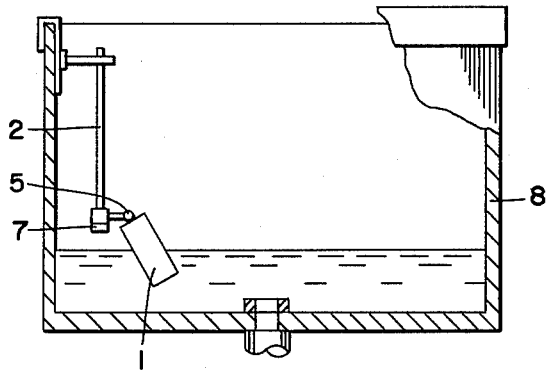

At the termination of the flush cycle, when the tank water level begins to recover, the water level can initially rise slightly above the lower extremity of the container when it is in the vertical position (FIG. 1B) thereby allowing a small amount of water to be caught in the container before it is forced back into its up-right position and refloated by the action of the rising water. The cycle now repeats itself with water in the container dissolving detergent and leaching out perfume once again.

Concurrently with the perfuming of the water and the discharge of the detergent into the water during the flush cycle, the descending water level creates a partial vacuum which draws air into the tank through the spaces around the cover. This entering air turbulently mixes with the highly fragranced air already in the tank head space and, as the water level in the tank recovers, this air, still containing a relatively high amount of volatile perfume oils, is forced out of the tank and into the room, thereby scenting the air in the room.

The fragrancing and cleansing device of this invention has several advantages over those disclosed and taught by the prior art. The most important such advantage is that the perfumed detergent is not in contact with the large body of water in the tank. Most of the prior art devices require having the detergent submerged in the water in the tank and attempt to accomplish their purpose by dispersing their perfume and detergent directly into the water in the tank. As a result, the detergent and perfume concentration within the tank is extremely low and most of that is flushed immediately down the drain without being in contact with the toilet bowl for any significant length of time to be able to effect any significant amount of cleansing or perfuming. The diluteness of the active ingredients in the water after the flush cycle is completed is exacerbated by the fact that the water which remains in the bowl between flushes has had virtually no contact with the perfumed detergent and thus is so dilute as to be of hardly any value at all.

By contrast, the device of this invention does not discharge its detergent and perfume into the flush water until all or substantially all of the water in the tank has been discharged and has passed through the toilet bowl to the sewer. As a result, the bulk of the perfume and detergent is discharged into the water which refills the toilet bowl and thus remains in the bowl between flushes. Likewise, following the flushing cycle, the perfume left in the air space in the tank is in substantially greater concentration than is the case with those devices which hold the detergent in contact with the water at all times and thus a greater, more concentrated volume of perfume can be pumped into the room from the tank.

As stated hereinabove, it is preferred that the perfumed detergent be a solid mass which adheres to the walls of the container. However, it is also possible for the apparatus to be adapted for permanent installation and for the detergent to be a solid cake which can be replaced when it is completely consumed.

In this latter case it is necessary for the container to have a cover on it through which the water can pass to get into contact with the detergent cake. This can readily be effected by having a cover with holes or slots through which water can pass but which will restrain the detergent cake from being spilled out when the container is in the substantially vertical position during the flush cycle. In fact, as an added safety feature, it is also possible to use this design when the detergent cake is adhered to the walls of the container as on some occasions the cake can come loose or break apart as it is consumed. Also, the slotted cover will enhance the diffusion of perfume from the wet detergent by exposing a larger surface area to the air inside the tank head space. In another embodiment of this invention, the container can be made detachable at or near the pivot point. This allows for the easy replacement of the entire container holding the detergent cake, thus preventing skin contact with the active ingredients.

The choice of detergents and perfuming compositions is not critical. Substantially any detergent of a properly selected water solubility can be used depending upon the desires of the user of the apparatus. The same is true as to perfumes, in fact, the perfume can be chosen to create whatever effect the user may wish, i.e citrus, floral, herbal, mint, balsamic or whatever perfume may come to mind. Choices of perfume and detergents are well within the skill of the practitioner.

Furthermore, auxiliary materials can be added to the product to provide beneficial effects. These can be combinations of various disinfectants, rust and stain removers, additives to prevent mineral deposits, surface protective agents, defoamers, deodorants, bleaches, sequestrants, dyes or pigments, strong acids or bases, bulking agents to lower cost and control dissolution rates, and the like. The choice of these materials is also well within the skill of the practitioner.

What I claim and desire to protect by Letters Patent is:

1. An in-tank toilet bowl cleansing and fragrancing device comprising a floatable container adapted to float on the surface of the water in a toilet bowl hold tank and to enclose a solid detergent material while leaving one of the surfaces of said solid detergent material exposed, means for securing said container in a toilet bowl hold tank with the exposed surface of the solid detergent out of contact with the body of water in the tank, and means for causing said container to rotate between a substantially horizontal and a substantially vertical position as the water level in the tank falls due to flushing and thereafter to return to the horizontal position as the water level recovers.

* * * * *